US007938652B2

(12) United States Patent
Yang et al.

(10) Patent No.: US 7,938,652 B2
(45) Date of Patent: May 10, 2011

(54) LOW PROFILE ELECTRICAL CONNECTOR

(75) Inventors: Sheng-Ho Yang, Tu-Cheng (TW); Chun-Chieh Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/840,317

(22) Filed: Jul. 21, 2010

(65) Prior Publication Data

US 2011/0021044 A1 Jan. 27, 2011

(30) Foreign Application Priority Data

Jul. 21, 2009 (TW) ..... 98213285

(51) Int. Cl.
*H01R 12/00* (2006.01)

(52) U.S. Cl. ..... 439/81

(58) Field of Classification Search ..... 439/78, 439/81–83

See application file for complete search history.

(56) References Cited

U.S. PATENT DOCUMENTS

| | | | | |
|---|---|---|---|---|
| 4,717,217 | A * | 1/1988 | Bogese, II | 439/83 |
| 5,188,535 | A * | 2/1993 | Bertho et al. | 439/83 |
| 5,383,797 | A * | 1/1995 | Seong et al. | 439/569 |
| 5,919,051 | A * | 7/1999 | Mitra | 439/74 |
| 5,938,456 | A * | 8/1999 | Kozel et al. | 439/83 |
| 2009/0053913 | A1 * | 2/2009 | Chen | 439/81 |

* cited by examiner

*Primary Examiner* — Briggitte R Hammond

(74) *Attorney, Agent, or Firm* — Wei Te Chung; Andrew C. Cheng; Ming Chieh Chang

(57) ABSTRACT

An electrical connector includes an insulative housing and a plurality of terminals secured in the insulative housing. The insulative housing defines a mating surface and a mounting surface opposite to the mating surface and includes a plurality of posts extending from the mounting surface away from the mating surface, the posts defining a distal surface. The insulative housing defines a plurality of mating passageways penetrating through the mating surface of the insulative housing and the distal surfaces of the posts and a plurality of receiving passageways corresponding to the mating passageways. Each terminal includes a retention portion retained in the receiving passageway, an engaging portion extending in one corresponding mating passageway and a soldering portion extending in the mounting face.

16 Claims, 7 Drawing Sheets

LOW PROFILE ELECTRICAL CONNECTOR

BACKGROUND OF THE INVENTION

1. Field of the Invention

The present invention relates to an electrical connector, and more particularly to a low profile electrical connector mounted on a printed circuit board.

2. Description of the Related Art

A conventional electrical connector typically includes a connector body having a mating surface, which is adapted to mate with a mating component, a mounting surface, which is adapted to face a printed circuit board, and a plurality of passageways extending from the mating surface towards the mounting surface through the connector body. Terminals are inserted into the respective passageways of the connector body. Each of the terminals includes a retention section adapted to engage with the inner wall of the passageway by an interference fit, a contact section received in the passageway and a tailing section to be mounted onto the printed circuit board. When the electrical connector is mounted onto the printed circuit board, it can't reduce the height of the electrical connector.

In view of the above, a new electrical connector that overcomes the above-mentioned disadvantages is desired.

SUMMARY OF THE INVENTION

Accordingly, an object of the present invention is to provide a low profile electrical connector mounted on a printed circuit board.

To fulfill the above-mentioned object, an electrical connector comprises an insulative housing and a plurality of terminals secured in the insulative housing. The insulative housing defines a mating surface and a mounting surface opposite to the mating surface and comprises a plurality of posts extending from the mounting surface away from the mating surface, the posts defining a distal surface. The insulative housing defines a plurality of mating passageways penetrating through the mating surface of the insulative housing and the distal surfaces of the posts and a plurality of receiving passageways corresponding to the mating passageways. Each terminal comprises a retention portion retained in the receiving passageway, an engaging portion extending in one corresponding mating passageway and a soldering portion extending in the mounting face.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

The present invention will now be described in detail with reference to a preferred embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

Figure 1:
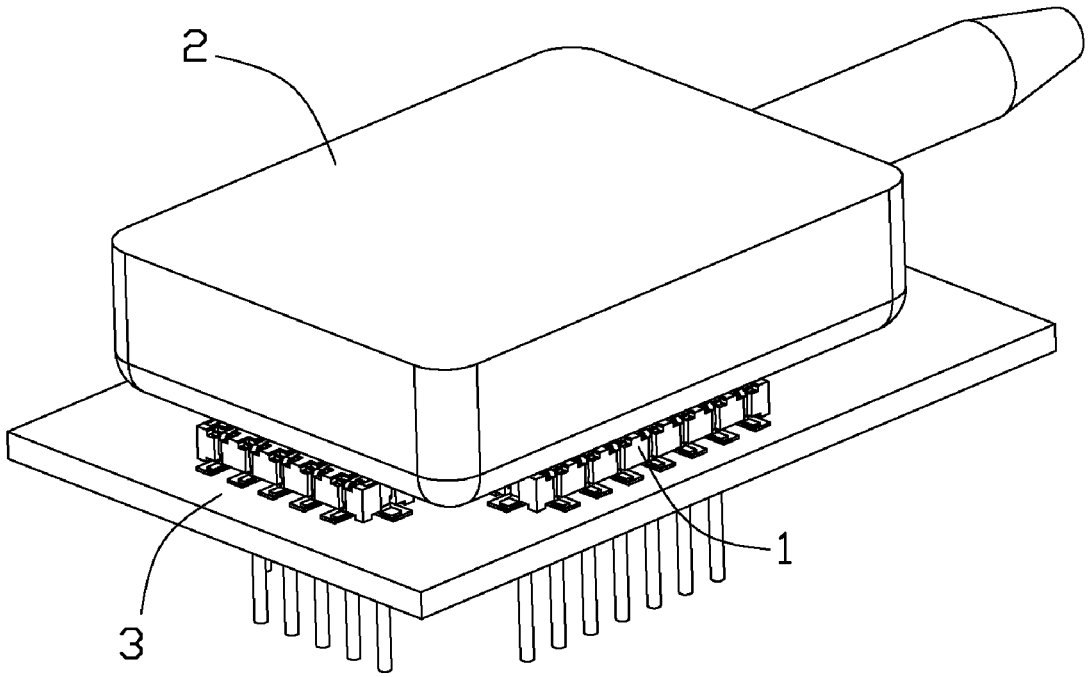
FIG. 1 is a perspective view of an interconnection system in accordance with an embodiment of the present invention.
Figure 2:
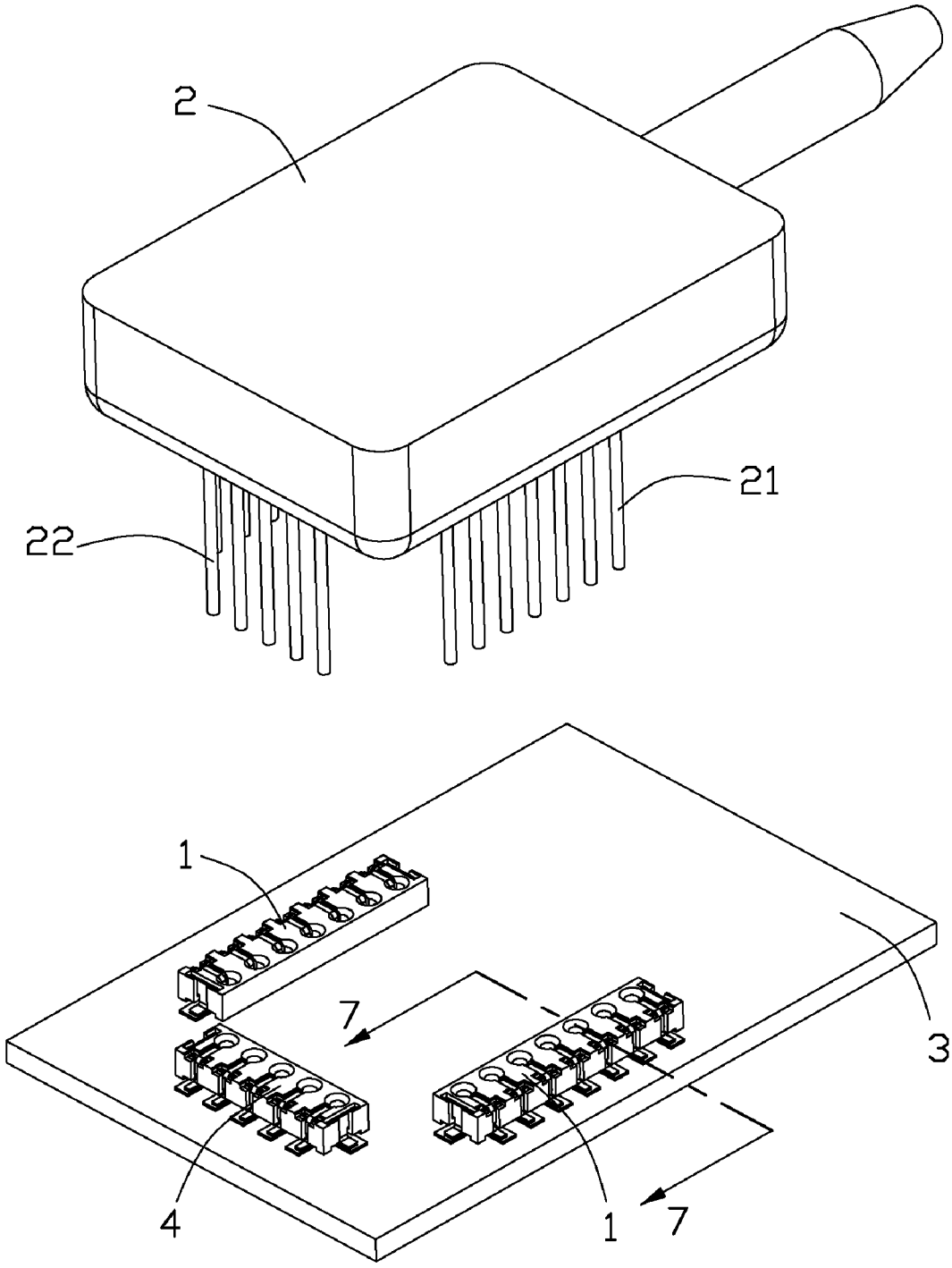
FIG. 2 is an exploded, perspective view of the interconnection system of the FIG. 1.
Figure 3:
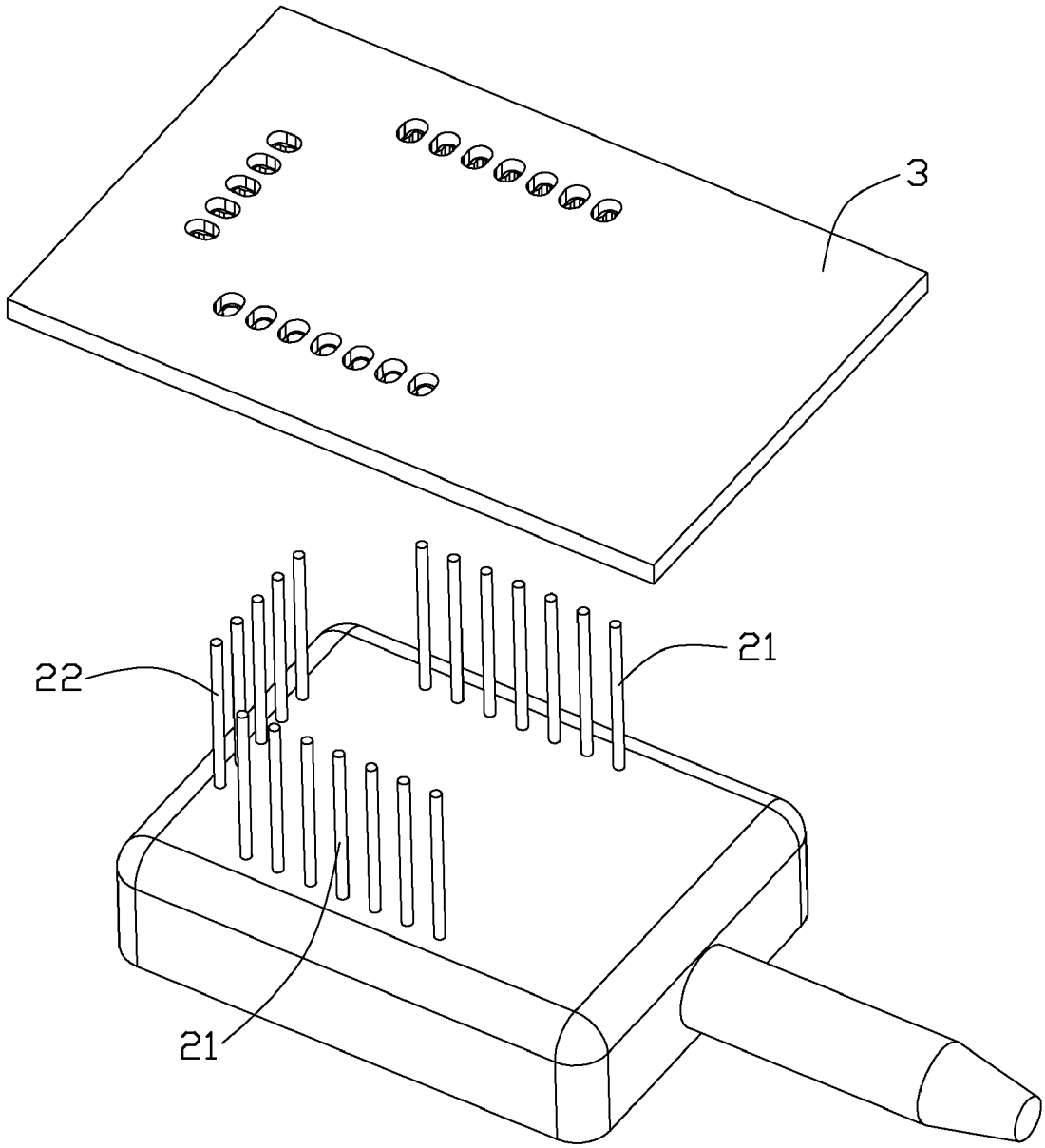
FIG. 3 is another view of the interconnection system of the FIG. 2.

Referring to FIGS. 1 to 3, an interconnection system according to an embodiment of the present invention comprises an electrical connector assembly comprising a printed circuit board (PCB) 3 and three electrical connectors 1, 4 mounted on the PCB 3, and an optical transceiver 2. The optical transceiver 2 comprises three rows of pins 21, 22 adapted for mating with the three electrical connectors 1, 4 respectively.

Figure 4:
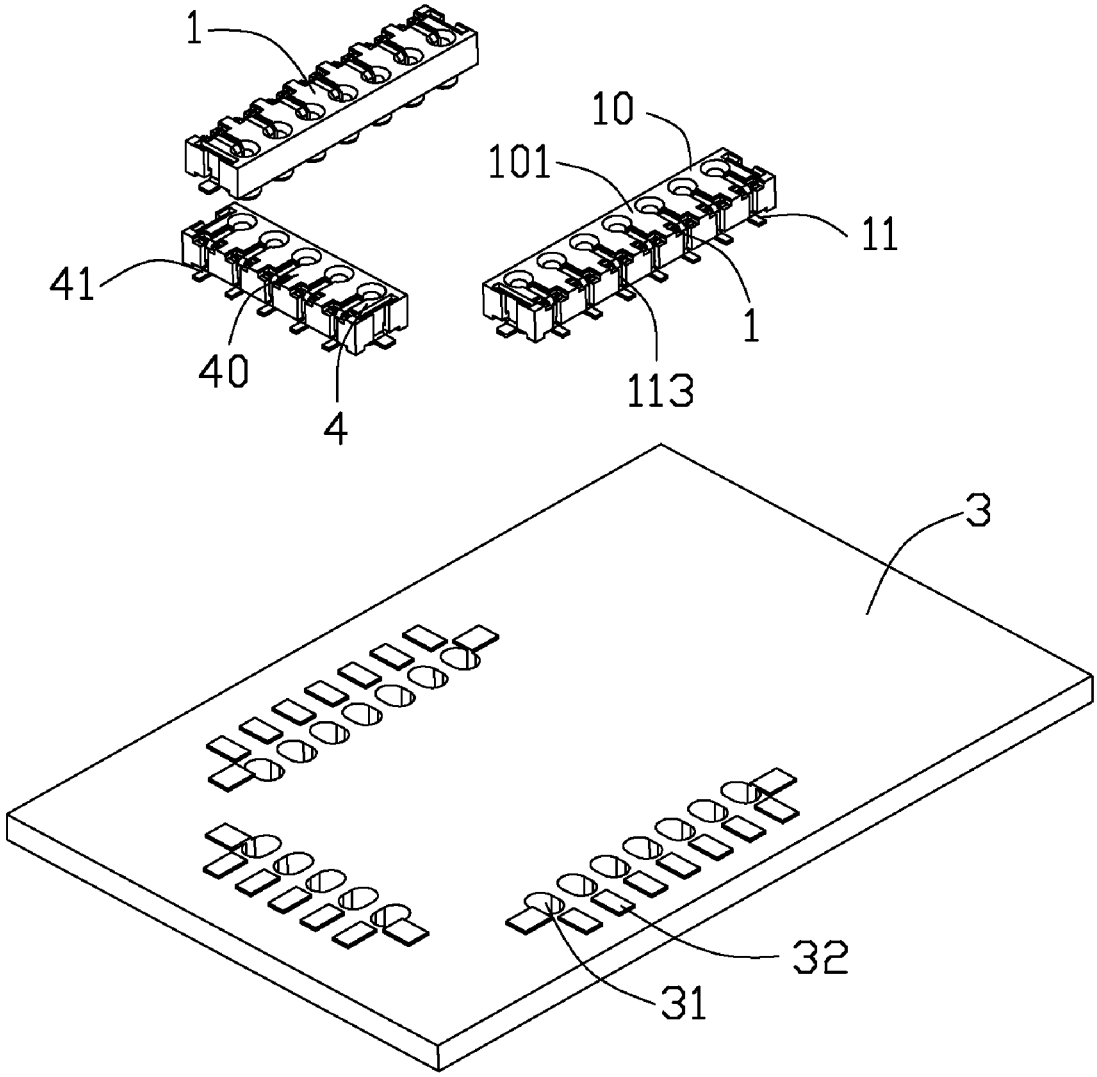
FIG. 4 is an exploded, perspective view of an electrical connector assembly of FIG. 1.
Figure 5:
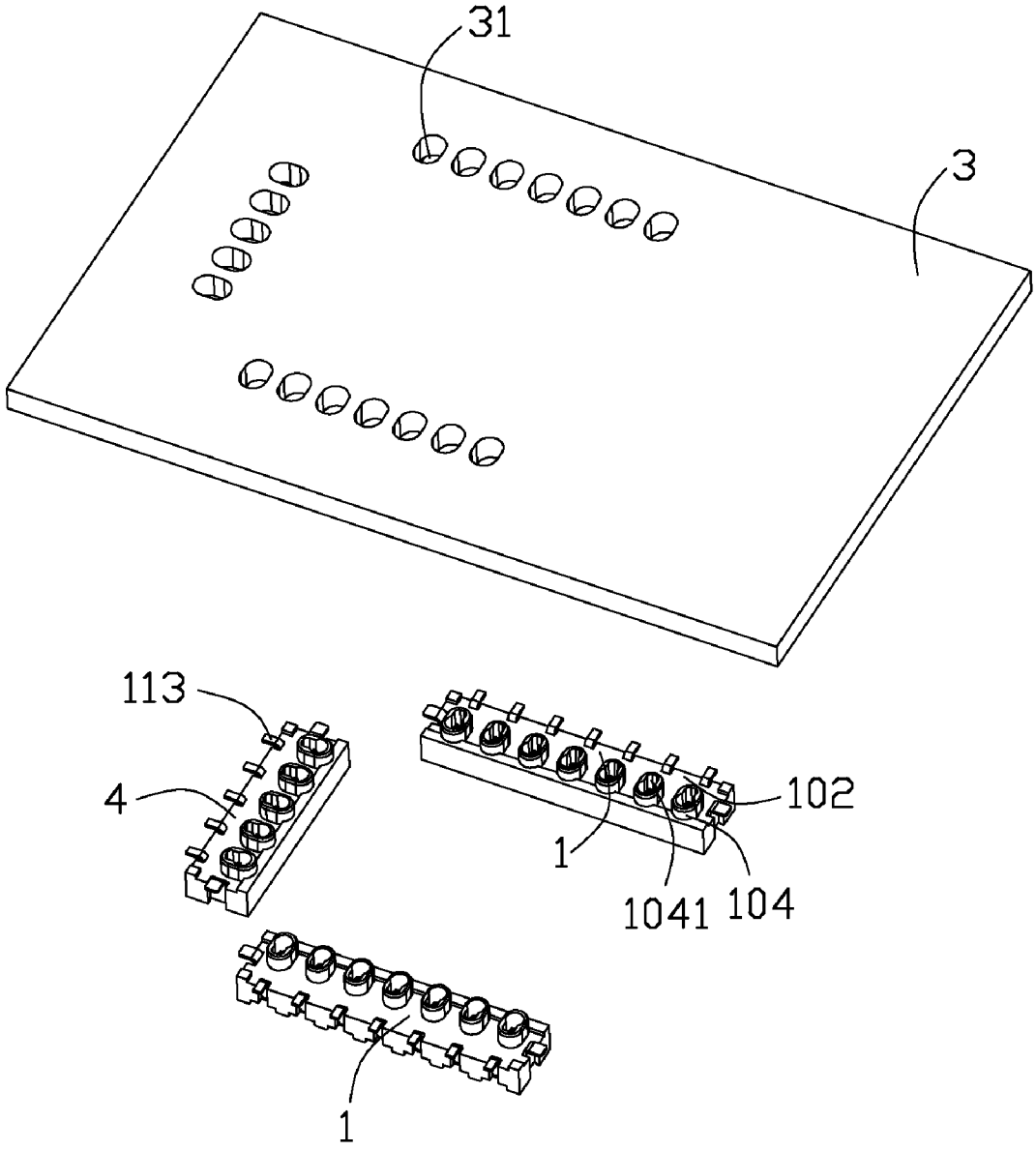
FIG. 5 is another view of the electrical connector assembly of FIG. 4.

Referring to FIGS. 4 to 5, the PCB 3 defines three rows of through holes 31 at three sides of a rectangle to correspond to said three electrical connectors 1, 4 and corresponding conductive pads 32 aligned with each through hole 31. The connectors are mounted to the conductive pads by soldering portions 113 of terminals 3 which will be described hereinafter. A pair of first electrical connectors 1 is located in parallel, and the second electrical connector 4 is located at one side of the two connectors 1. The first electrical connector 1 is structurally similar to the second electrical connectors 4. Differently, the first electrical connector 1 comprises a longer insulative housing 10 and seven terminals 11 secured in the housing 10, and the second electrical connector 4 comprises a shorter insulative housing 40 and five terminals 41 secured in the housing 40. Description will be given about the first electrical connector 1 to illustrate the structure of the electrical connectors.

Figure 6:
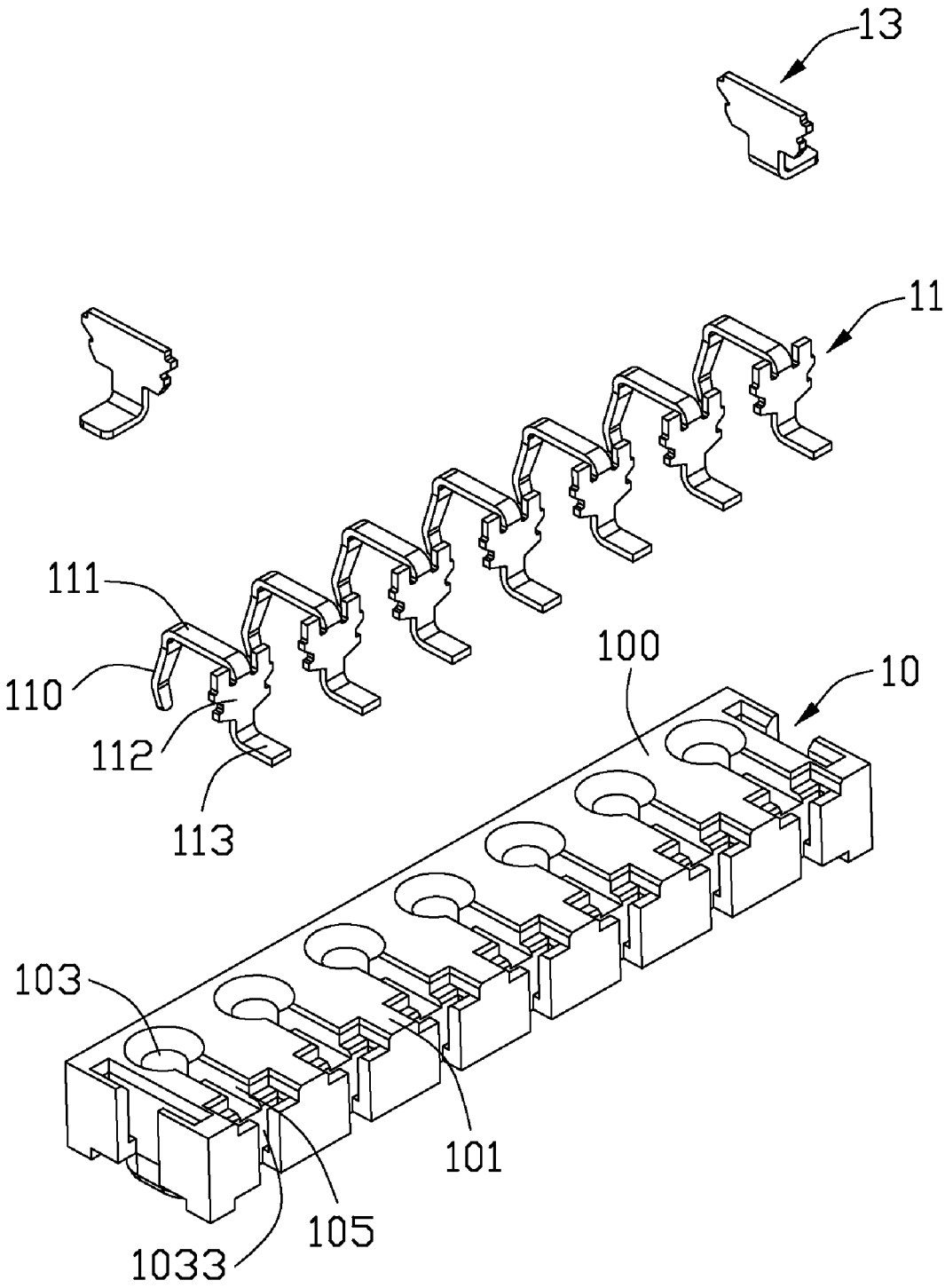
FIG. 6 is an exploded, perspective view of an electrical connector of FIG. 1.
Figure 7:
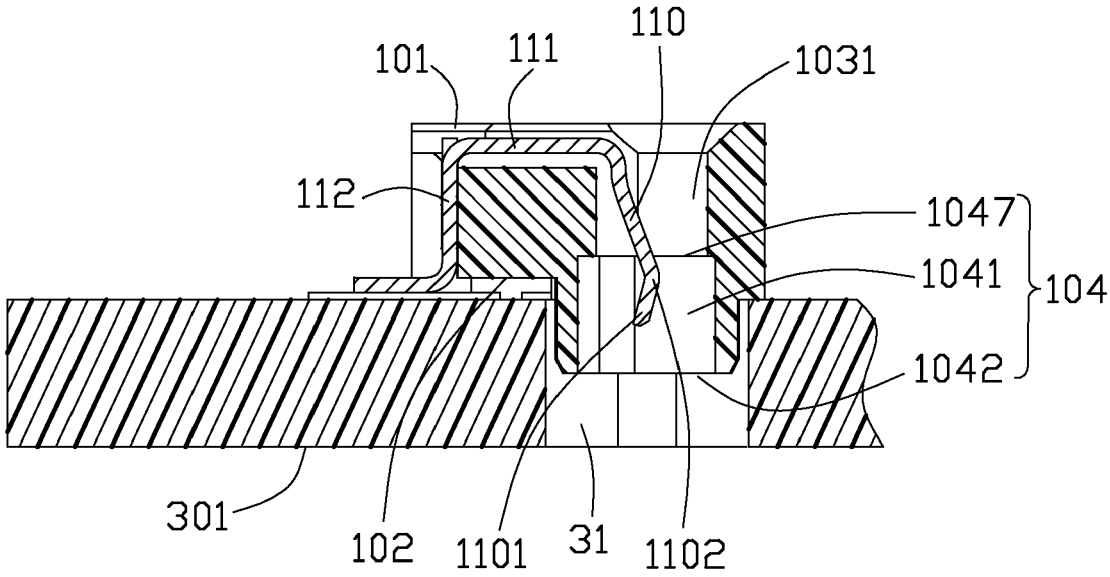
FIG. 7 is a cross sectional view of the electrical connector assembly of FIG. 2.

Referring to FIGS. 6 to 7, the insulative housing 10 comprises a base portion 100 defining a mating surface 101 and a mounting surface 102 (labeled in FIG. 5) opposite to the mating surface 101 and a plurality of posts 104 downwards extending from the mounting surface 102 which is adapted for being received in corresponding through holes 31 of the PCB 3. The posts 104 define a distal surface 1042 as shown in FIG. 7. A plurality of mating passageways 103 penetrate through the mating surface 101 of the base 102 and the distal surface 1042 of the posts 104. Each mating passageway 103 comprises a first section 1031 near to the mating surface 101 and a second section 1041 near to the distal surface 1042 of the post 104. The two sections communicate with each other and the second section is larger than the first section in traverse direction perpendicular to the extending direction of the mating passageways. A pair of board locks 13 is retained in two ends of the base portion to be soldered to the pads on the PCB 3.

The base portion 102 further comprises receiving passageways corresponding to the mating passageways, which includes a third section 105 parallel to and opening to the mating surface 101 and a fourth section 1033 connecting with the third section and running through the mating surface and the mounting surface.

Each terminal 11 comprises a vertical retention portion 112 with barbs received and retained in the forth section 1033 of the passageway and a cantilever engaging portion 110 extending in the second section 1041 from the mating surface 101. The engaging portion is connected with the retention portion by a horizontal connection portion 111 parallel to the mating surface, which is received in the third section of the passageway. The soldering portion 113 extends from the other end of the retention portion 112 and parallel to the mounting face. The soldering portion 113 extends outwardly beyond the third section 1033 and in the mounting surface 100 so as to be soldered to the PCB 3. The engaging portion 110 of the terminal 11 extends slantways toward the distal surface 1042 of the post. The terminals are assembled to the receiving passageways and the mating passageways from the mating surface 101. The engaging portion 110 slantwise extend away the mating surface 101 and the retention portion 112 with a distal end 1101 bending back towards the retention portion 112.

The transverse dimension of the second section 1041 is larger than that of the first section 1031 so that a distal end of the engaging portion 110 of each terminal 11 is received in the second section 1041 of the passageway 103 and do not touch the inner wall of the second section 1041 so as to provide high elasticity. The distal surface 1042 is located below the mounting face 102 and above a bottom face 301 of the PCB 3, i.e. the distal surface of the post is at a middle height of the mating passageways 103. The second section 1041 has a top 1047 higher than the mounting face 102. The distal end of the engaging portion 110 is located between the mounting surface 100 and the distal surface 1042. The contacting point 1102 of the engaging portion is located below the top of the second section 1047 of the second section. The posts 104 of the insulative housing are inserted into the through holes 31 of the PCB 3 so as to reduce the height of the electrical connector assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating surface and a mounting surface opposite to the mating surface and comprising a plurality of posts extending from the mounting surface away from the mating surface, the posts defining a distal surface;

the insulative housing defining a plurality of mating passageways penetrating through the mating surface of the insulative housing and the distal surfaces of the posts and a plurality of receiving passageways corresponding to the mating passageways; and a plurality of terminals secured in the insulative housing, each terminal comprising a retention portion retained in the receiving passageway, an engaging portion extending in one corresponding mating passageway and a soldering portion extending in the mounting face.

2. The electrical connector as claimed in claim 1, wherein the terminal comprises a connecting portion connecting with the retention portion and the engaging portion and the connecting portion is parallel to and opening to the mating face.

3. The electrical connector as claimed in claim 2, wherein the retention portion is perpendicular to the mating surface and opening to the mating surface.

4. The electrical connector as claimed in claim 3, wherein each passageway comprising a first section near to the mating surface and a second section near to the distal surface of the post, the second section is larger than the first section in a transverse dimension, the engaging portions of the terminals extend slantways toward the distal surface.

5. The electrical connector as claimed in claim 4, wherein a top of the second section of the mating passageway is located above the mounting face of the insulative housing and a contacting point of the terminal is below the top of the second section.

6. An electrical connector assembly comprising:

a printed circuit board (PCB) defining a plurality of through holes and conductive pads aligned with corresponding through holes;

an electrical connector defining a mounting surface confronting with a first face of the PCB, a mating surface opposite to the mounting face and a plurality of post extending from the mounting face to be received in corresponding through holes; the electrical connector defining mating passageways each running through the mating surface and each post so as to communicate with each through hole and comprising terminals each received in the each mating passageway; and a plurality of terminals secured in the housing, each terminal comprising an engaging portion extending in the mating passageway from the mating surface and a soldering portion extending out of the mounting face to be soldered to the conductive pads of the PCB.

7. The electrical connector assembly as claimed in claim 6, wherein each terminal comprises a connecting portion retained in and opening to the mating face and the engaging portion unitarily extending from the connecting portion.

8. The electrical connector assembly as claimed in claim 7, wherein the mating passageway comprises a first section near to the mating surface and a second section near to a distal surface of the post, the second section is larger than the first section in a transverse dimension, the engaging portion of the terminal extends slantways toward the distal surface.

9. The electrical connector assembly as claimed in claim 7, wherein contacting points of the engaging portions of the terminals are located in a substantially same level to the mounting surface of the insulative housing.

10. An electrical connector assembly comprising:

a printed circuit board defining opposite first and second surface with a plurality of through holes extending therethrough;

an electrical connector including:

an insulative housing including a main body mounted upon the first surface and a plurality of posts downwardly extending from a bottom face of the main body and received in the corresponding through holes, respectively, under condition that each of said posts defines an inner through passageway axially;

a plurality of contacts disposed in the housing, each of said contacts including a resilient contacting section extending into the corresponding through passageway; wherein a distal end region of the contacting section of each contact is essentially located in the corresponding through hole for efficiently mating with a pin like terminal which is inserted into the through passageway in a mounting direction from the first surface to the second surface.

11. The electrical connector assembly as claimed in claim 10, wherein the post does not extend beyond the second surface.

12. The electrical connector assembly as claimed in claim 10, wherein each of said contacts defines a solder tail mounted upon the first surface.

13. The electrical connector assembly as claimed in claim 10, wherein the contacting section extends downwardly into the corresponding through passageway.

14. The electrical connector assembly as claimed in claim 10, wherein the housing is configured to allow each of said contacts to be assembled to the housing in said mounting direction.

15. The electrical connector assembly as claimed in claim 10, wherein said pin like terminal is a part of an transmission component which is downwardly mounted to the connector in said mounting direction.

16. The electrical connector assembly as claimed in claim 10, wherein more than one of said connectors are mounted to the printed circuit board and commonly mating with a same transmission component.

* * * * *